US011311056B2

(12) United States Patent
Payne

(10) Patent No.: US 11,311,056 B2
(45) Date of Patent: Apr. 26, 2022

(54) SYSTEM AND METHOD OF MAINTAINING POCKET SQUARE FORM IN A POCKET

(71) Applicant: SQUARED AWAY POCKET SQUARE MOVEMENT LLC, North Aurora, IL (US)

(72) Inventor: Jeffrey Christopher Payne, North Aurora, IL (US)

(73) Assignee: Squared Away Pocket Square Movement LLC, North Aurora, IL (US)

( * ) Notice: Subject to any disclaimer, the term of this patent is extended or adjusted under 35 U.S.C. 154(b) by 55 days.

(21) Appl. No.: 15/976,464

(22) Filed: May 10, 2018

(65) Prior Publication Data

US 2018/0332903 A1 Nov. 22, 2018

Related U.S. Application Data

(60) Provisional application No. 62/603,262, filed on May 22, 2017.

(51) Int. Cl.

| | |
|---|---|
| ***A41B 15/02*** | (2006.01) |
| ***A45F 5/04*** | (2006.01) |
| ***A45F 5/02*** | (2006.01) |

(52) U.S. Cl.

CPC ..... *A41B 15/02* (2013.01); *A45F 5/022* (2013.01); *A45F 5/04* (2013.01)

(58) Field of Classification Search

CPC ..... A41B 15/02; A41B 15/00; A45F 5/04; A41D 2300/24

See application file for complete search history.

(56) References Cited

U.S. PATENT DOCUMENTS

| | | | | |
|---|---|---|---|---|
| 2,060,729 A * | 11/1936 | Gilgenbach | ..... | A41B 15/02 2/279 |
| 2,511,242 A * | 6/1950 | Brown | ..... | A41B 15/02 2/279 |
| 2,513,884 A * | 7/1950 | Maurer | ..... | A41B 15/02 2/279 |
| 2,849,722 A * | 9/1958 | Cohen | ..... | A41B 15/02 2/279 |
| 3,026,532 A * | 3/1962 | Janz | ..... | A41B 15/02 2/279 |

(Continued)

OTHER PUBLICATIONS

Ties.com, How To Fold the Presidential Pocket Square, Sep. 28, 2016, Ties.com https://web.archive.org/web/20160928184417/https://www.ties.com/how-to-fold-a-pocket-square/presidential.*

*Primary Examiner* — Khoa D Huynh
*Assistant Examiner* — Erick I Lopez
(74) *Attorney, Agent, or Firm* — Duane Morris LLP

(57) ABSTRACT

A system of maintaining the form of a pocket square comprises an insert, a pocket square sleeve, and a holder. The insert comprises a semi-rigid or rigid material. The pocket square sleeve comprises fabric sewn along a lengthwise seam to form a sleeve and a second seam substantially perpendicular to the lengthwise seam forming a cavity configured to receive the insert. The holder comprises an elongate member and a fastening element, the elongate member configured to be folded to cause engagement of the fastening element. The insert is disposed in the cavity of the pocket square sleeve and the combined insert and pocket square sleeve is disposed in the holder with the fastening element engaged.

20 Claims, 17 Drawing Sheets

(56) References Cited

U.S. PATENT DOCUMENTS

| | | | | |
|---|---|---|---|---|
| 2015/0059062 | A1* | 3/2015 | McClellan | A41B 15/02 2/279 |
| 2015/0157059 | A1* | 6/2015 | Muratore, II | A41B 15/02 2/279 |

* cited by examiner

SYSTEM AND METHOD OF MAINTAINING POCKET SQUARE FORM IN A POCKET

CROSS-REFERENCE TO RELATED APPLICATIONS

This application claims priority to U.S. Provisional Patent Application No. 62/603,262, filed May 22, 2017, the entirety of which is herein incorporated by reference.

BACKGROUND

Pocket squares are a well-known accessory in the fashion industry. A pocket square is typically a square- or rectangular-shaped piece of fabric such as silk, cotton, or linen. The pocket square is folded and placed in a pocket (typically the breast pocket of a suit jacket) such that it protrudes from the pocket, typically on the order of ½ to three centimeters of the pocket square being visible as protruding from the pocket. Through the use of different fabrics (including different colors, patterns, and textures), as well as different folding techniques and degrees of protrusion, the pocket square offers a wide range of ways to accent a suit jacket. This wide range of accents via pocket square can be coupled with an equally wide range of suit jacket, shirt, socks, and tie selections to create a nearly endless variety to a suit.

Despite their versatility, pocket squares suffer from many drawbacks that are also well-known to the fashion industry and consumers in general. Because pocket squares are simply a piece of fabric and are typically made from finer fabrics, they lack the rigidity to hold their form for long periods of time. In addition, the linings of many pockets include fabrics that are not conducive to maintaining the position of a pocket square. As a result, a pocket square placed in the breast pocket of a suit jacket will frequently sag or slide down into the pocket (reducing the amount of the pocket square visibly protruding from the pocket), move side-to-side within the pocket, or become bunched. When a pocket square loses its form in these ways, it destroys the desired style and presentation of the pocket square, such as the crisp presentation of a pocket square line protruding from the breast pocket. Pocket squares are also notoriously difficult to fold and place in the breast pocket.

Many in the fashion industry have made previous attempts to overcome these shortcomings. For example, certain companies now offer the option to have a pocket square sewn into place in the breast pocket of a suit jacket. While this solution may overcome the problem of the pocket square losing its form during wear, it obviously creates a new problem in that the suit jacket and pocket square are now attached to each other, such that the user cannot easily change the styling of the suit jacket. This solution therefore destroys the versatility afforded through the use of pocket squares.

Similarly, some in the fashion industry have taken to sewing a pocket square to a structural member such as a piece of cardboard, and then inserting the sewn-together pocket square and structural member combination into a breast pocket. Sewing the pocket square in a fixed orientation or fold pattern reduces the versatility of the pocket square (which could otherwise be folded in numerous styles) and can be problematic for laundering.

Another solution known in the industry is the use of a plastic sleeve or pouch that envelops a portion of the pocket square. This solution is akin to a common plastic "change purse" design, having a plastic sleeve that is closed on three sides but open on the fourth side. Squeezing the sleeve near the open fourth side causes temporary deformation of the sleeve to create an opening large enough to place a pocket square inside, and cessation of the squeezing pressure allows the sleeve to close and grip the pocket square. The "change purse" sleeve and pocket square are then inserted into the breast pocket. This solution is less than ideal because the pocket square is typically hard to place in the sleeve since the sleeve is closed on three sides. The pocket square—again, typically made of delicate or fine fabric and folded with some degree of precision—is required to be stuffed into a plastic sleeve at one end without disrupting the presentation of the other end that will protrude from the breast pocket. This is difficult to accomplish and often results in a poor presentation of the pocket square in the breast pocket.

As none of these prior solutions have succeeded in maintaining the versatile nature of the pocket square while correcting for the tendency to lose shape, there is thus a long felt need in the fashion industry for improvements to the use of pocket squares.

SUMMARY

According to some aspects of the present disclosure, a system of maintaining the form of a pocket square comprises an insert, a pocket square sleeve, and a holder. The insert comprises a semi-rigid material. The pocket square sleeve comprises fabric sewn along a lengthwise seam to form a sleeve and a second seam substantially perpendicular to the lengthwise seam forming a cavity configured to receive the insert. The holder comprises an elongate member and a fastening element, and the elongate member is configured to be folded to cause engagement of the fastening element.

In some embodiments the insert is disposed in the cavity of the pocket square sleeve and the combined insert and pocket square sleeve is disposed in the holder. In some embodiments the pocket square sleeve is closed with a third seam proximate an end of the sleeve, said third seam substantially perpendicular to the lengthwise seam. In some embodiments the pocket square sleeve is dimensioned such that folding the pocket square sleeve to fit into a pocket requires folding the pocket square sleeve in a single dimension. In some embodiments the pocket is a breast pocket of a suit jacket. In some embodiments folding the pocket square sleeve in quarters along a lateral dimension achieves an appropriate dimension of a folded pocket square sleeve to fit into the pocket.

In some embodiments the fastening element comprises a hook and loop fastener, with a hook panel disposed opposite the loop panel when the elongate member is in a folded position, wherein folding the holder about the combined insert and pocket square sleeve causes engagement of a portion of the hook panel with a portion of the loop panel. In some embodiments the fastening element comprises a pair of magnets, with a first magnet having a first polarity disposed opposite a second magnet having a second polarity when the elongate member is in a folded position, wherein folding the holder about the combined insert and pocket square sleeve causes engagement between the pair of magnets sufficient to hold the holder about the combined insert and pocket square sleeve.

According to further aspects of the present disclosure, a system of maintaining the form of a pocket square comprises a pocket square, a semi-rigid insert, and a holder. The pocket square comprises a polygonal piece of fabric configured to be folded to a polygonal shape dimensioned to fit substantially within the breast pocket of a suit jacket. The semi-rigid insert is dimensioned to fit substantially within the breast pocket of a suit jacket and configured to be folded within the pocket square. The holder comprises an elongate member and a fastening element, with the elongate member configured to be folded to cause engagement of the fastening element. The insert is folded within the pocket square and the combined insert and pocket square is partially disposed within the holder, with the fastening element of the holder at least partially engaged.

In some embodiments the fastening element comprises a hook and loop fastener, with a hook panel disposed opposite the loop panel when the elongate member is in a folded position, wherein folding the holder about the combined insert and pocket square causes engagement of a portion of the hook panel with a portion of the loop panel. In some embodiments the fastening element comprises a pair of magnets, with a first magnet having a first polarity disposed opposite a second magnet having a second polarity when the elongate member is in a folded position, wherein folding the holder about the combined insert and pocket square causes engagement between the pair of magnets sufficient to hold the holder about the combined insert and pocket square. In some embodiments the fastening element comprises an elastic band configured to extend between and couple opposing sides of the elongate member when the elongate member is in a folded position to hold the holder about the combined insert and pocket square. In some embodiments the elastic band is attached in at least one location to the elongate member. In some embodiments the fastening element comprises a clasp configured to extend between and couple opposing sides of the elongate member when the elongate member is in a folded position to hold the holder about the combined insert and pocket square.

According to yet further aspects of the present disclosure, a method of maintaining the form of a pocket square comprises: inserting an insert into a cavity of a pocket square sleeve, the pocket square sleeve comprising fabric sewn along a lengthwise seam to form a sleeve and a second seam substantially perpendicular to the lengthwise seam forming a cavity configured to receive the insert; folding the pocket square sleeve having the insert disposed in the cavity to form a folded pocket square sleeve insert; placing the folded pocket square sleeve insert in a holder, the holder comprising an elongate member and a fastening element; and folding the elongate member to engage the fastening element such that the folded pocket square sleeve insert is held by the holder.

In some embodiments the step of folding the pocket square sleeve comprises folding in a single dimension to achieve a folded pocket square sleeve insert dimensioned to fit in the breast pocket of a suit jacket. In some embodiments the pocket square sleeve is folded in quarters. In some embodiments the step of folding the elongate member comprises folding the elongate member in a bi-fold manner such that a first portion of an interior surface of the elongate member substantially faces a second portion of the interior surface.

In some embodiments the fastening element comprises a hook and loop fastener, with a hook panel disposed opposite the loop panel when the elongate member is in a folded position, wherein folding the holder about the folded pocket square sleeve insert causes engagement of a portion of the hook panel with a portion of the loop panel. In some embodiments the fastening element comprises a pair of magnets, with a first magnet having a first polarity disposed opposite a second magnet having a second polarity when the elongate member is in a folded position, wherein folding the holder about the folded pocket square sleeve insert causes engagement between the pair of magnets sufficient to hold the holder about the folded pocket square sleeve insert.

BRIEF DESCRIPTION OF THE DRAWINGS

The following will be apparent from elements of the figures, which are provided for illustrative purposes.

Figure 1B:
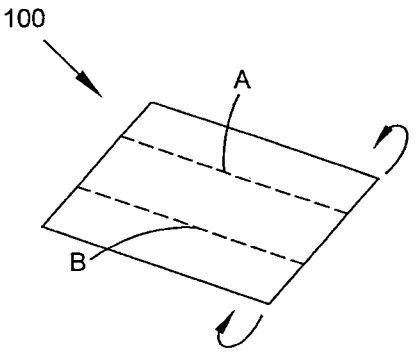
FIGS. 1B, 1C, 1D, and 1E provide simplified isometric views of the folding of the pocket square of FIG. 1A to include an insert, in accordance with some embodiments of the present disclosure.

While the present disclosure is susceptible to various modifications and alternative forms, specific embodiments have been shown by way of example in the drawings and will be described in detail herein. It should be understood, however, that the present disclosure is not intended to be limited to the particular forms disclosed. Rather, the present disclosure is to cover all modifications, equivalents, and alternatives falling within the spirit and scope of the disclosure as defined by the appended claims.

DETAILED DESCRIPTION

For the purposes of promoting an understanding of the principles of the disclosure, reference will now be made to a number of illustrative embodiments in the drawings and specific language will be used to describe the same.

The present disclosure is directed to systems and methods of maintaining the form of a pocket square when disposed in a pocket. The disclosed systems and methods overcome the aforementioned deficiencies, namely the tendency of a pocket square to lose its shape or form when worn in a pocket, while preserving the versatility of the pocket square as a fashion accessory. The disclosed system of maintaining the form of a pocket square may comprise a pocket square, an insert, and a pocket square holder. The pocket square may be a typical square or rectangular-shaped piece of fabric or a fabric of varying shapes and sizes, or may be a fabric sleeve as disclosed below.

In some embodiments of the present disclosure, a typical pocket square 100 is used. FIG. 1A is an isometric view of a typical pocket square 100 that is well-known in the fashion industry and to the general public. Pocket square 100 comprises a polygonal piece of fabric, such as a square or rectangle. The fabric may comprise silk, cotton, linen, or similar material, or a blend of materials.

Figure 1A:
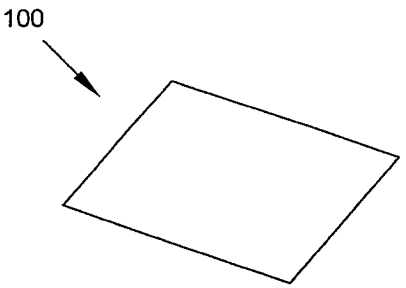
FIG. 1A is a simplified isometric view of a typical pocket square.
Figure 1C:
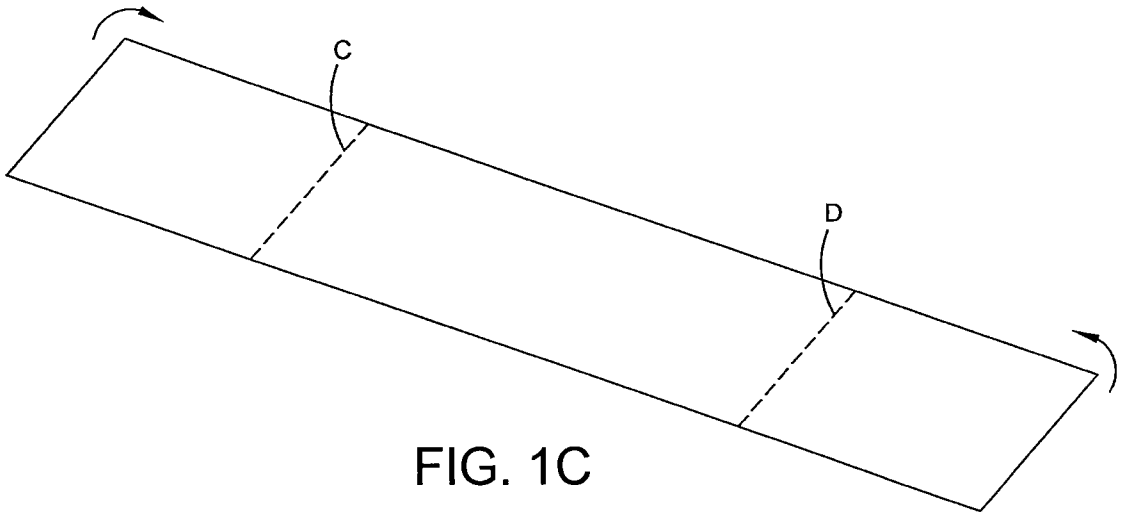
Figure 1D:
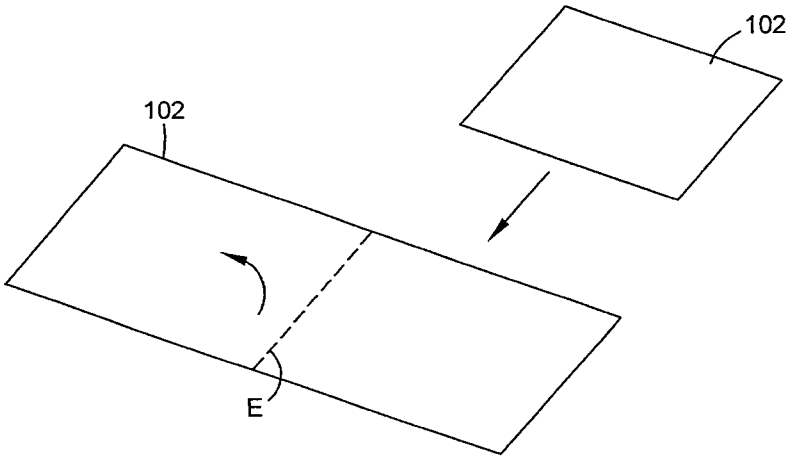

FIGS. 1B, 1C, and 1D provide isometric views of the folding of a pocket square 100 to include an insert 102 in accordance with some embodiments of the present disclosure. Pocket square 100 is first folded in a lateral dimension (typically lengthwise for rectangular-shaped pieces of fabric) as illustrated in FIG. 1B. In the illustrated embodiment the pocket square 100 is folded in thirds; however, additional folding divisions, such as by quarters, are contemplated. By folding the pocket square 100 along fold lines A and B and as indicated by the arrows of FIG. 1B, the pocket square 100 presents a reduced width at a constant length as compared to the pocket square 100 of FIG. 1A. The reduced width achieved by the folding illustrated in FIG. 1B allows for placement of the pocket square 100 in a pocket. In other words, the reduced width is less than the width of the pocket in which the folded pocket square is to be placed.

Moving to FIG. 1C, the pocket square 100 is next folded along fold lines C and D, as indicated by the arrows of FIG. 1C. Prior to executing these folds, an insert 102 is placed as shown. The insert 102 comprises a rigid or semi-rigid material such as plastic, cardboard, polyurethane, vinyl or similar materials, and is dimensioned to be the approximate desired dimensions of a folded pocket square. In other words, the insert 102 may be dimensioned slightly smaller than the dimensions of a typical breast pocket of a suit jacket. In some embodiments, the insert 102 is 8.5 cm by 8 cm. When folded into the pocket square 100 as illustrated in FIGS. 1B, 1C, and 1D, the insert 102 will provide structural rigidity to the folded pocket square. It is desirable that the rigid or semi-rigid material used for the insert 102 allows the insert 102 to be thin so as not to be bulky and/or noticeable when disposed in a pocket.

Figure 1E:
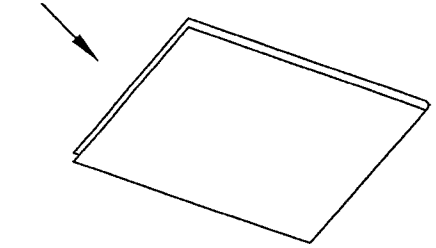

At FIG. 1D, the pocket square 100 is further folded along fold line E as indicated by the arrow of FIG. 1D. This fold completes the folding of the pocket square 100. The final combination of a folded pocket square 100 and insert 102—which this application shall refer to as a folded pocket square insert 110—is illustrated in the isometric view of FIG. 1E.

Figure 2A:
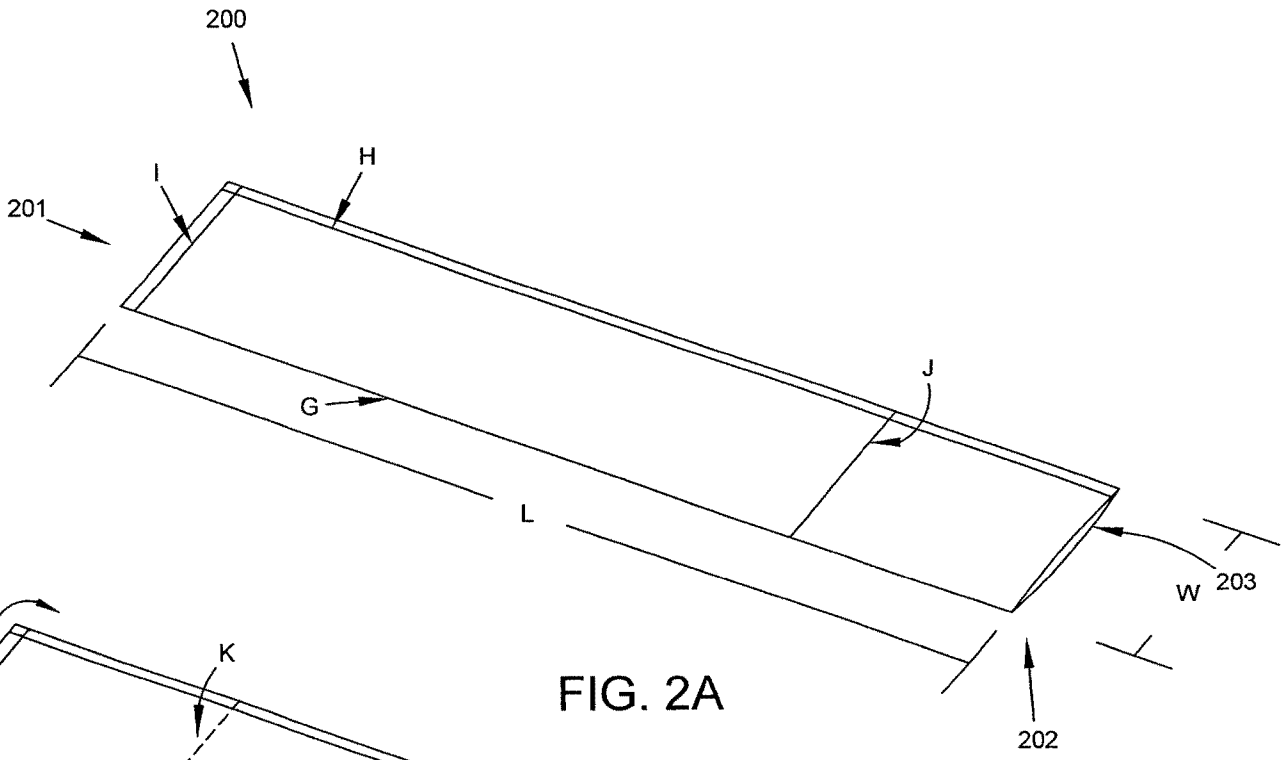
FIG. 2A is a simplified isometric view of a pocket square sleeve in accordance with some embodiments of the present disclosure.

In some embodiments of the present disclosure, a pocket square sleeve 200 is used instead of a standard pocket square 100 such as that described above. FIG. 2A is an isometric view of a pocket square sleeve 200 in accordance with some embodiments of the present disclosure. A pocket square sleeve 200 comprises a rectangular piece of fabric that is folded onto itself at edge G and sewn at seam H to create a tube, or sleeve, of fabric.

The tube is closed at a first end 201 by a sewn seam I, and closed at an offset from an opposing end 202 by a sewn seam J. The offset between the end 202 of the tube and seam J creates a fabric cavity 203.

Pocket square sleeve 200 typically has a width W slightly less than the width of the breast pocket of a suit jacket. Such a width eliminates the need for laterally folding the pocket square sleeve 200 (such as the lateral folding illustrated for a pocket square 100 in FIG. 1B). In other words, the pocket square sleeve 200 can, in some embodiments, be prepared for insertion into a pocket by only folding the sleeve 200 in a single dimension, rather than in multiple dimensions such as shown in FIGS. 1A-1E with reference to a typical pocket square 100. The pocket square sleeve 200 can be folded only along the length L of the sleeve (i.e. executing folds perpendicular to the length dimension), and need not be folded along the width W of the sleeve (i.e. no folds executed parallel to the length dimension).

In some embodiments, the length of the pocket square sleeve 200 is dimensioned such that the sleeve 200 is folded lengthwise in quarters, as shown and described below with reference to FIGS. 2B and 2C. In some embodiments, the pocket square sleeve 20Q measures 8.5 cm wide by 40 cm long.

Figure 2B:
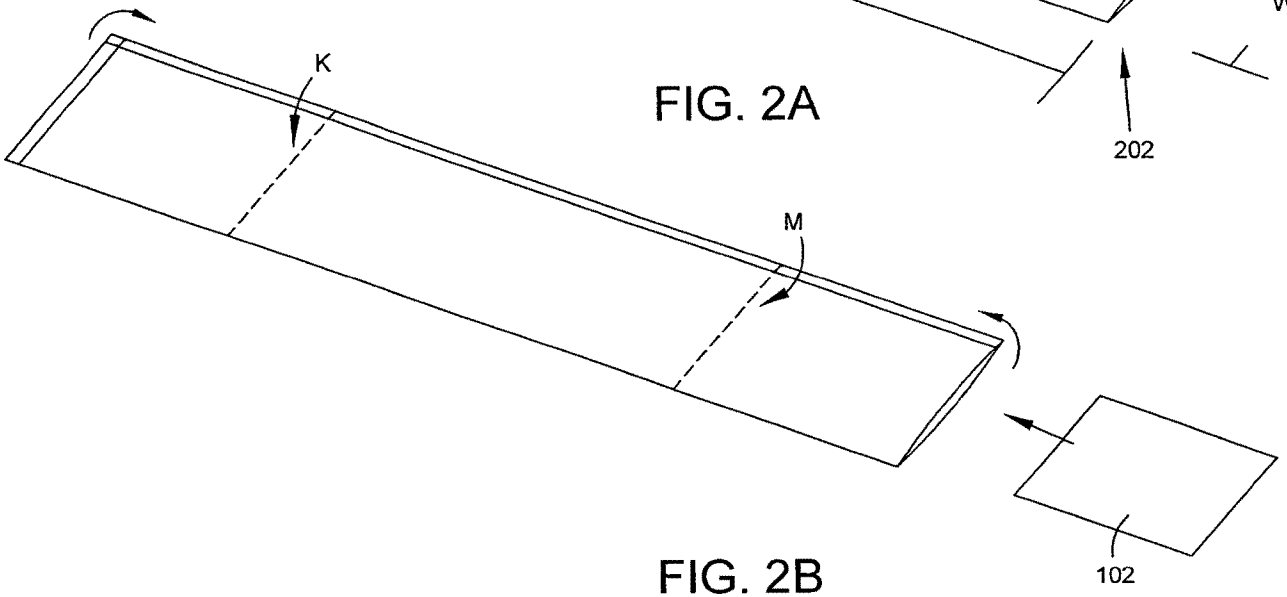
FIGS. 2B, 2C, and 2D provide simplified isometric views of the folding of the pocket square sleeve of FIG. 2A to include an insert, in accordance with some embodiments of the present disclosure.
Figure 2D:
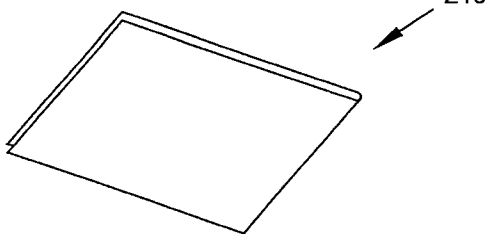
Figure 2C:
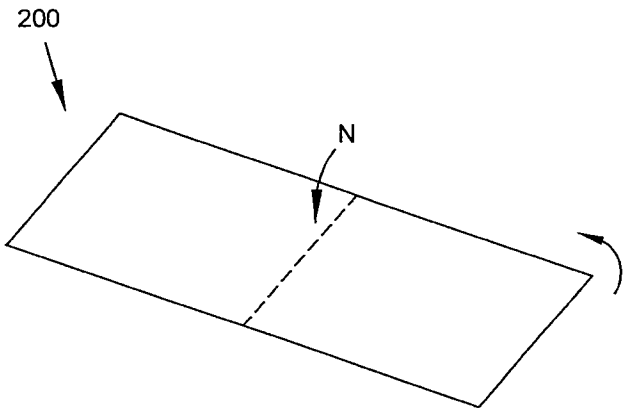

FIGS. 2B and 2C provide isometric views of the folding of a pocket square sleeve 200 in accordance with some embodiments of the present disclosure. First, an insert 102 is inserted into the cavity 203 of the pocket square sleeve 200. The insert 102 may be as described above with reference to FIGS. 1A-1E. In some embodiments the insert 102 is inserted into the cavity 203 by a user, and in other embodiments the insert 102 may be inserted into the cavity 203 before being shipped to the user. In some embodiments the cavity 203 may be sewn shut to enclose the insert 102 after the insert 102 is inserted into the cavity 203.

The pocket square sleeve 200 is folded along fold lines K and M, as indicated by the arrows of FIG. 2B. The pocket square sleeve is then folded along fold line N, as indicated by the arrow of FIG. 2C. This fold completes the folding of the pocket square sleeve 200. The final combination of a folded pocket square sleeve 200 and insert 102—which this application shall refer to as a folded pocket square sleeve insert 210—is illustrated in the isometric view of FIG. 2D.

Figure 3A:
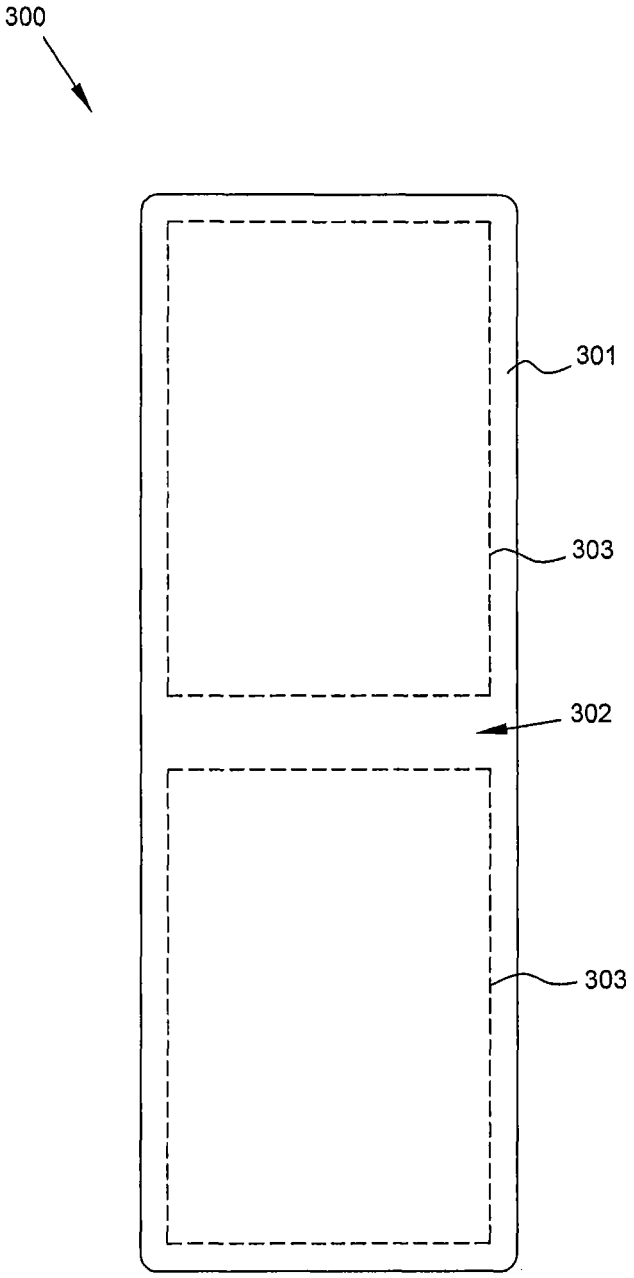
FIG. 3A is a simplified profile view of the exterior side of a pocket square holder in accordance with some embodiments of the present disclosure.
Figure 3B:
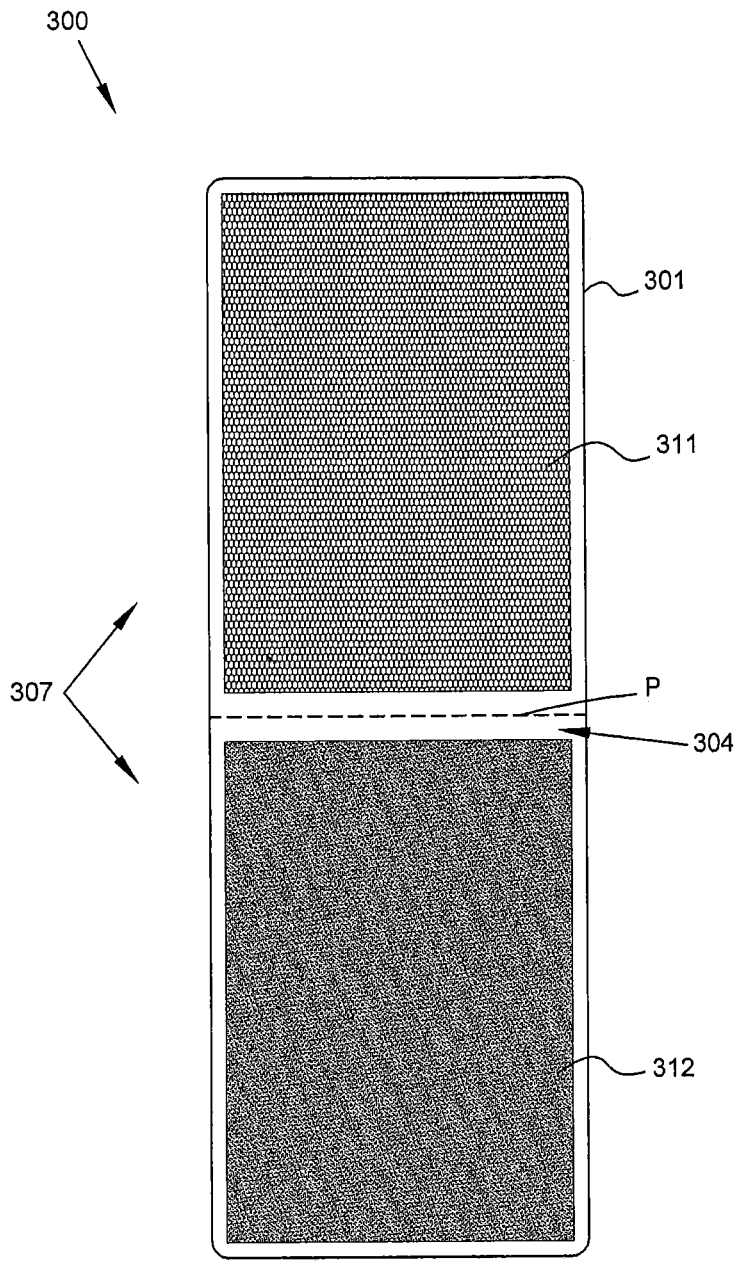
FIG. 3B is a simplified profile view of the interior side of the pocket square holder of FIG. 3A in accordance with some embodiments of the present disclosure.
Figure 3C:
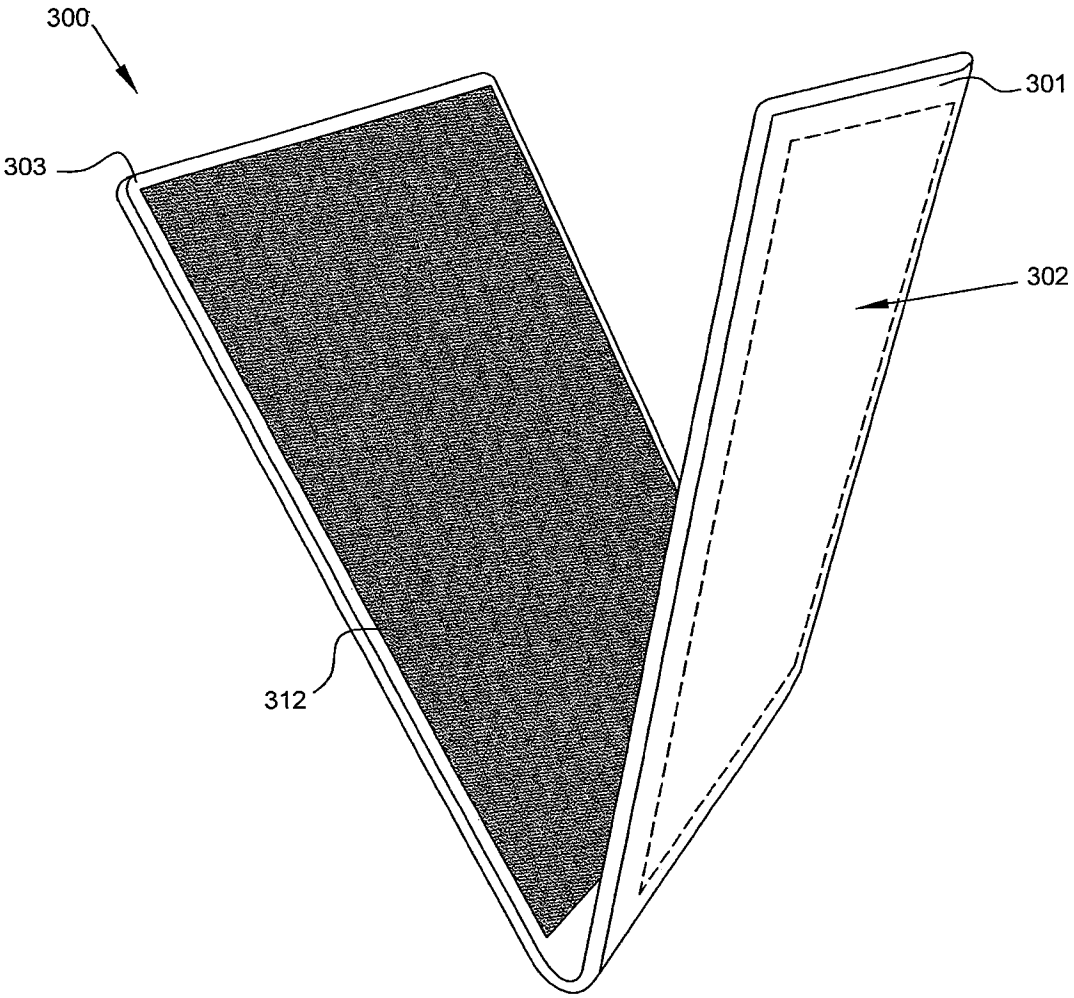
FIG. 3C is a simplified isometric view of the pocket square holder of FIGS. 3A and 3B in accordance with some embodiments of the present disclosure.

FIGS. 3A, 3B, and 3C provide illustrations of a pocket square holder 300 in accordance with some embodiments of the present disclosure. Pocket square holder 300 comprises an elongate member 301 and fastening element 307.

Elongate member 301 has a first or exterior side 302 and a second or interior side 304. Elongate member 301 may be formed of leather, polyurethane, flexible plastic, vinyl, or similar material. Elongate member 301 has a folding seam P that divides the elongate member 301 substantially in half. The opposing halves of elongate member 301 are configured such that folding elongate member 301 along fold seam P causes the elongate member 301 to fold in a bi-fold fashion.

In the embodiment illustrated in FIGS. 3A-3C, fastening element 307 is a hook and loop fastener comprising a first or loop panel 311 and a second or hook panel 312. When pressed together, loop panel 311 and hook panel 312 engage to form a non-permanently bonded surface that is detachable by pulling the panels 311, 312 apart. The engaged loop panel 311 and hook panel 312 hold the elongate member 301 together as a folded bi-fold.

Figure 7A:
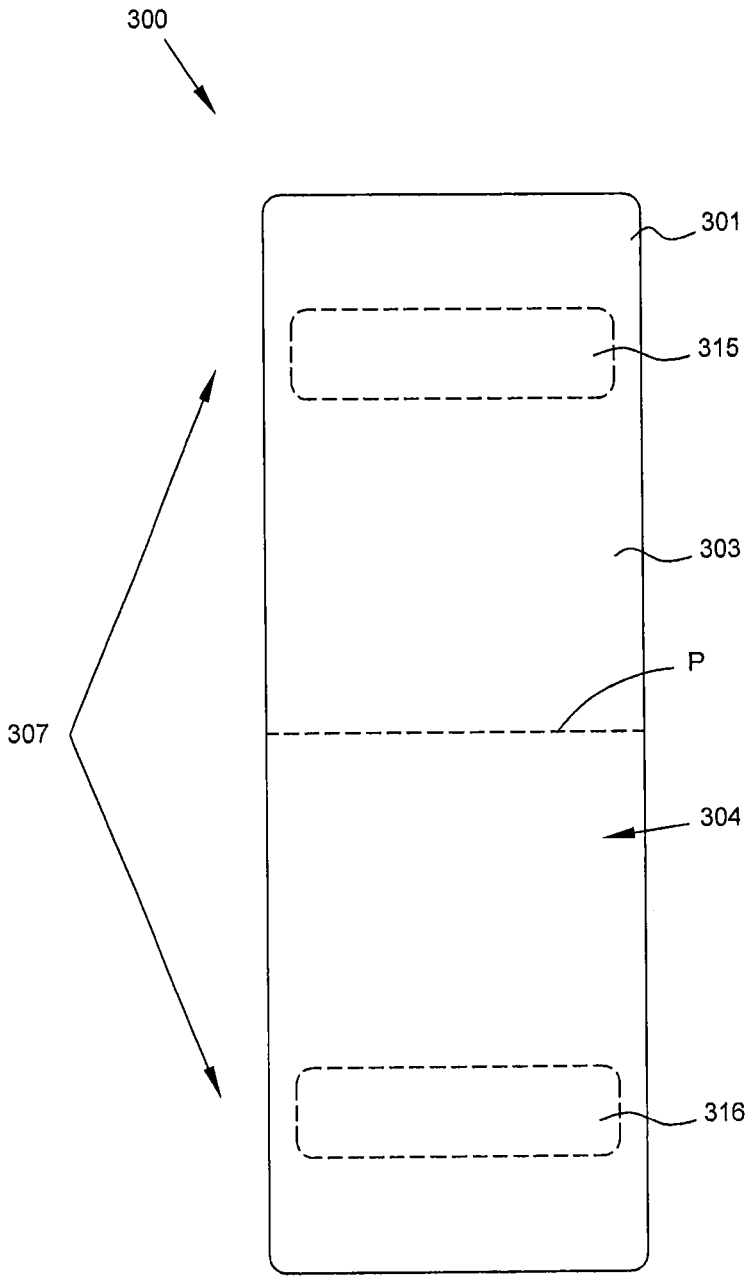
FIG. 7A is a simplified profile view of the interior side of a pocket square holder in accordance with some embodiments of the present disclosure.
Figure 7B:
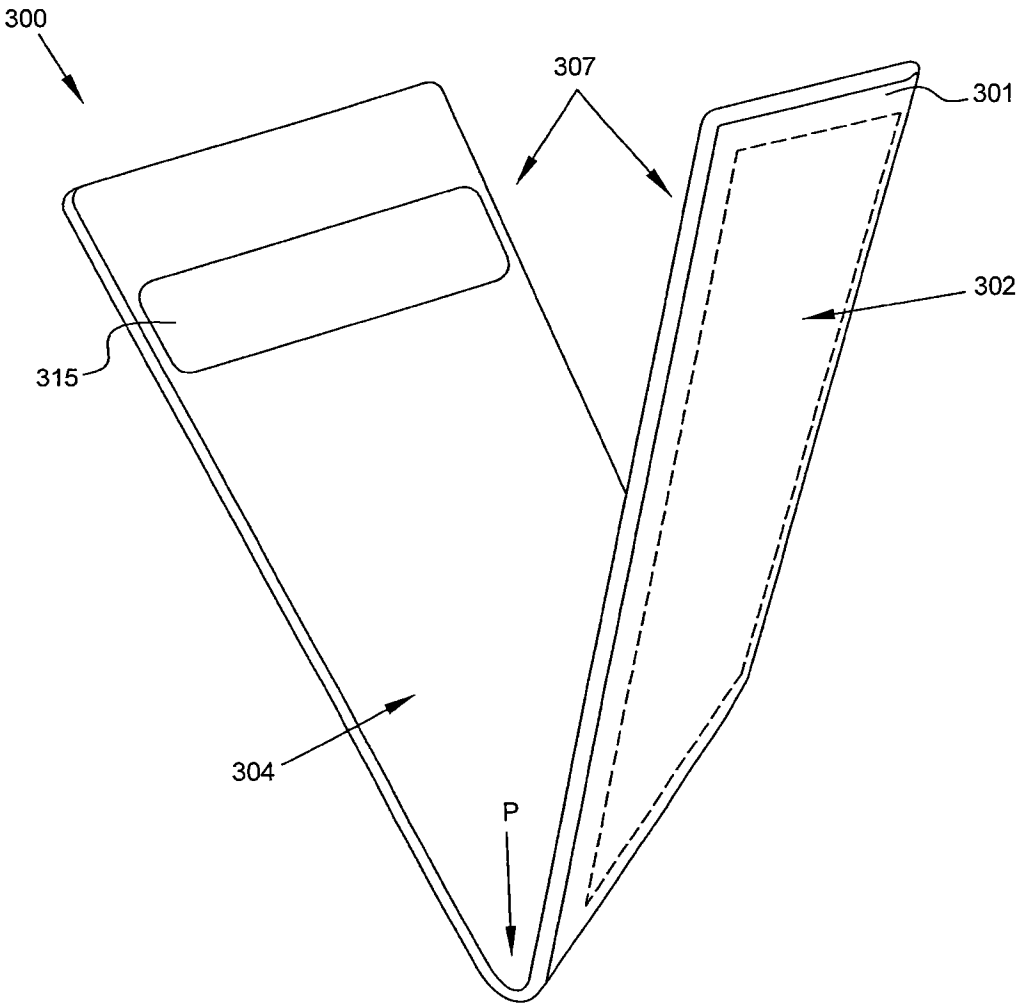
FIG. 7B is a simplified isometric view of the pocket square holder of FIG. 7A in accordance with some embodiments of the present disclosure.

Additional fastening elements 307 are contemplated, such as magnets, clasps, buckles, snaps, elastic bands, temporary adhesive, and similar fasteners. FIGS. 7A and 7B provide illustrations of an alternative pocket square holder 300 with a fastening element 307 of a first magnet 315 of a first polarity and a second magnet 316 of a second polarity disposed on opposing sides of fold seam P. The magnets 315, 316 are coupled to the interior side 304 of elongate member 301, and positioned in an opposing manner such that folding the elongate member along fold seam P will bring the magnets 315, 316 into sufficiently close proximity to form a non-permanent magnetic hold between the magnets 315, 316. Magnets may also be sewn into or otherwise integrated into the elongate member 301 so that the magnets are not visible, but are still attracted to each other sufficient to maintain the pocket square in place.

The magnets 315, 316 may be coupled to the elongate member 301 using an adhesive, a pouch configuration, or similar acceptable coupling means. The magnets 315, 316 may be offset from the fold seam P as well as the lengthwise ends of the elongate member 301. Although the magnets 315, 316 are shown as a single, rectangular-shaped magnet on each side of the fold seam P, additional embodiments are contemplated comprising an additional number of magnets, additional magnet shapes, and additional magnet placement within the interior surface 304 of the elongate member 301. In embodiments having more than one magnet on each side of the fold seam P, the magnets on a single side of the fold seam P may have the same polarity or different polarities.

In some embodiments fastening element 307 comprises one or more elastic bands configured to extend around the holder 300 and pocket square sleeve insert 210. The one or more elastic bands may extend between and couple opposing sides of the elongate member 301. The one or more elastic bands may be attached in at least one location to the elongate member 301. In other embodiments fastening element 307 comprises a clasp configured to extend between and couple opposing sides of the elongate member 301.

The positioning of a folded pocket square sleeve insert 210 within the pocket square holder 300 determines the height of the pocket square when placed in a pocket, which can also be described as the extent to which the pocket square protrudes from the pocket. FIGS. 4A, 4B, 5A, and 5B are illustrative. Although these figures are described with reference to the placement of a folded pocket square sleeve insert 210, it is to be understood that a folded pocket square insert 110 may be substituted for the folded pocket square sleeve insert 210 in accordance with some embodiments of the present invention. Similarly, although these figures are described with reference to the pocket square holder 300 described in FIGS. 3A-3C, it is to be understood that similar pocket square holders—for example, the pocket square holder 300 described with reference to FIGS. 7A and 7B—may be utilized with equal success.

Figure 5A:
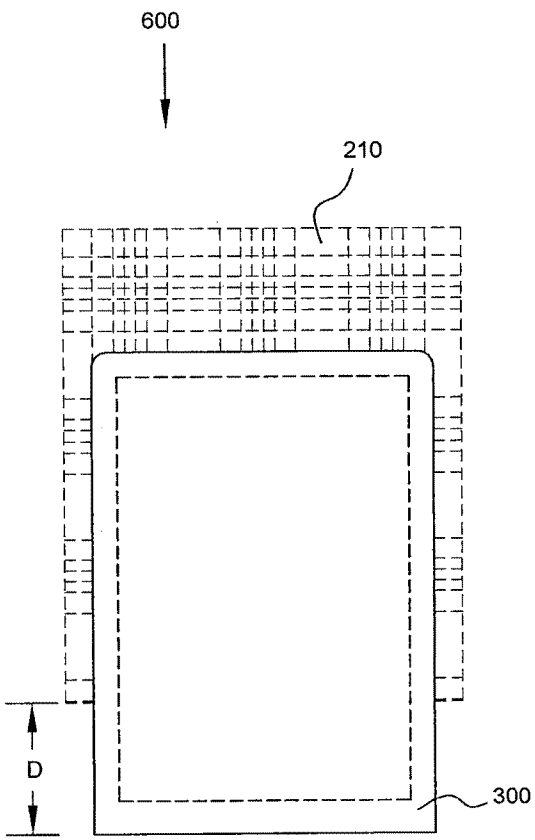
FIG. 5A is a simplified front profile view of a folded pocket square sleeve insert disposed in a pocket square holder in accordance with some embodiments of the present disclosure.
Figure 4A:
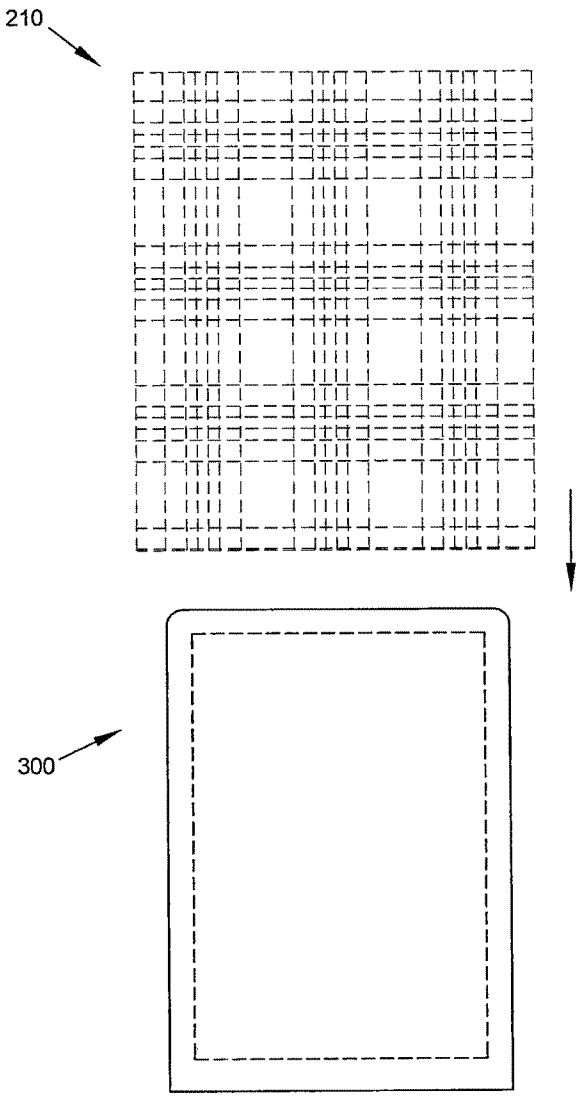
FIG. 4A is a simplified front profile view of a folded pocket square sleeve insert and pocket square holder in accordance with some embodiments of the present disclosure.
Figure 5B:
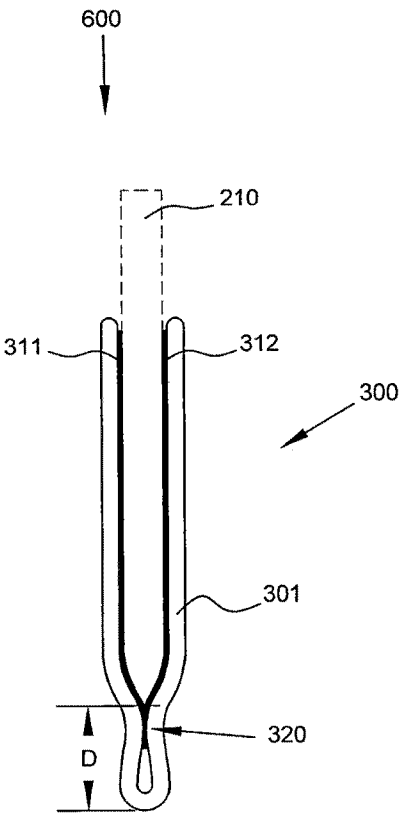
FIG. 5B is a simplified side profile view of a folded pocket square sleeve insert disposed in a pocket square holder in accordance with some embodiments of the present disclosure.
Figure 4B:
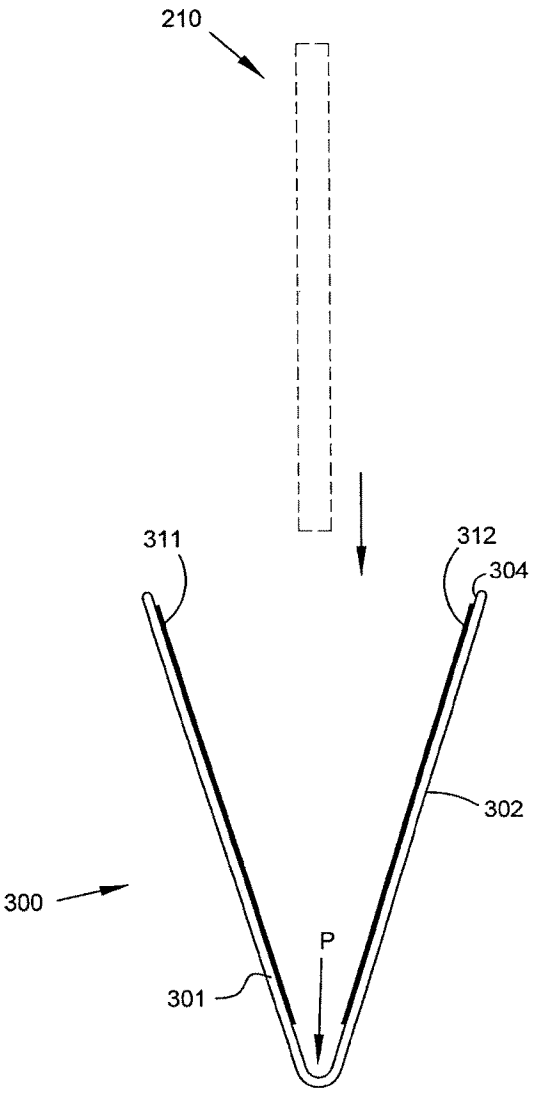
FIG. 4B is a simplified side profile view of the folded pocket square sleeve insert and pocket square holder of FIG. 4A in accordance with some embodiments of the present disclosure.

FIGS. 4A and 5A provide front profile views of a folded pocket square sleeve insert 210 and pocket square holder 300, with FIG. 4A showing the folded pocket square sleeve insert 210 and pocket square holder 300 before coupling and FIG. 5A showing the folded pocket square sleeve insert 210 and pocket square holder 300 after coupling. Similarly, FIGS. 4B and 5B provide side profile views of a folded pocket square sleeve insert 210 and pocket square holder 300, with FIG. 4B showing the folded pocket square sleeve insert 210 and pocket square holder 300 before coupling and FIG. 5B showing the folded pocket square sleeve insert 210 and pocket square holder 300 after coupling.

As shown in these figures, the pocket square holder 300 is placed or held in an open position in which the fastening element 307 is not engaged (in the illustrated embodiment, the loop panel 311 and hook panel 312 are not coupled). In the open position, the pocket square holder 300 may be partially folded along fold seam P, such that respective sides of interior surface 304 are substantially facing each other.

The folded pocket square sleeve insert 210 is positioned within the open pocket square holder 300 (in the illustrated embodiment, between loop panel 311 and hook panel 312). The pocket square holder 300 is then folded additionally along fold seam P until the fastening element 307 fastens opposing sides of the interior surface 304. In the illustrated embodiment, the pocket square holder 300 is folded until at least a portion of loop panel 311 is engaged with at least a portion of hook panel 312. The engagement of the fastening element 307 holds opposing sides of the interior surface 304 together, such that the pocket square holder 300 is holding or gripping the folded pocket square sleeve insert 210.

By varying the position of the folded pocket square sleeve insert 210 within the pocket square holder 300, and more specifically by varying the depth D to which the folded pocket square sleeve insert 210 is inserted into the pocket square holder 300, the user is able to control and vary the extent to which the folded pocket square sleeve insert 210 will protrude from a pocket. Positioning the folded pocket square sleeve insert 210 in a manner that increases the depth D shown in FIGS. 5A and 5B will cause the folded pocket square sleeve insert 210 to protrude to a greater extent, while positioning the folded pocket square sleeve insert 210 in a manner that decreases the depth D will cause the folded pocket square sleeve insert 210 to protrude to a lesser extent.

Figure 6:
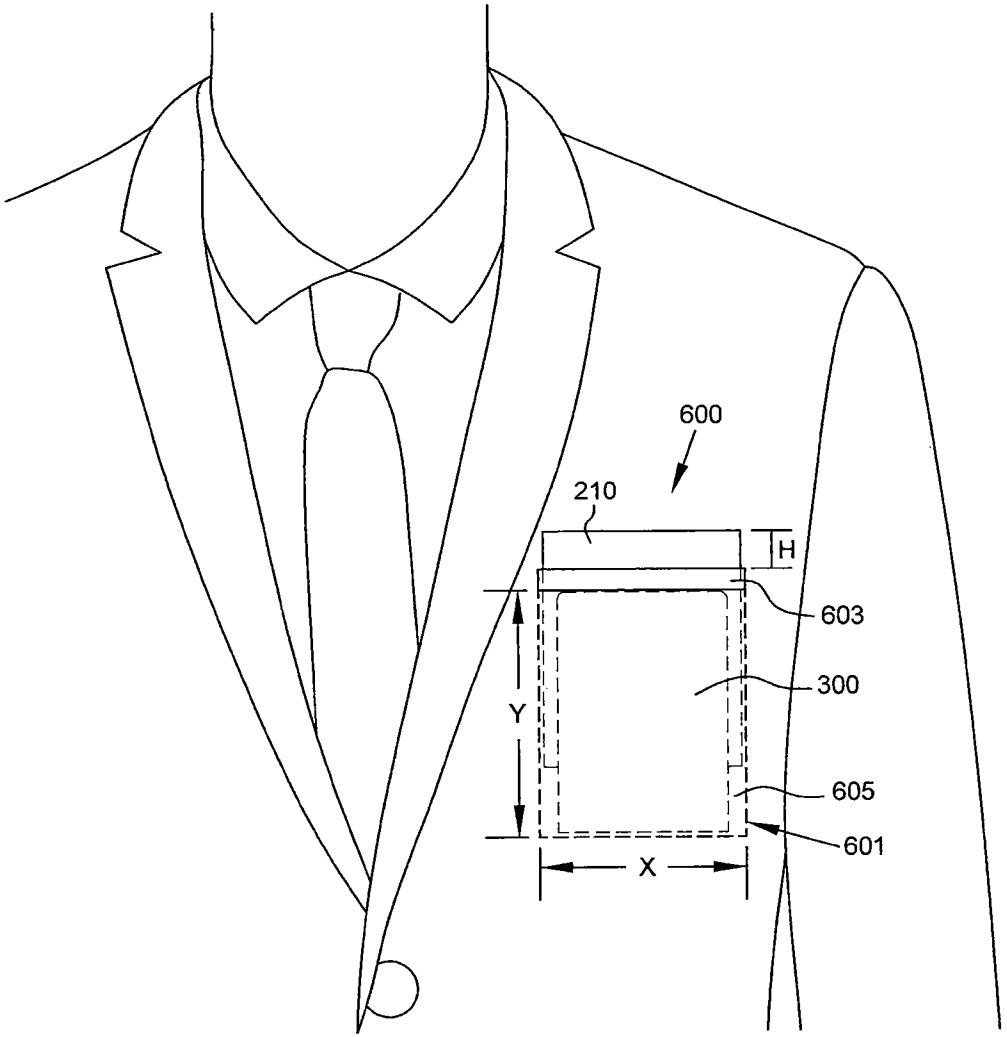
FIG. 6 is a simplified view of a folded pocket square insert and pocket square holder combination disposed in the breast pocket of a suit jacket in accordance with some embodiments of the present disclosure.

The combined folded pocket square sleeve insert 210 and pocket square holder 300—referred to herein as the combined element 600—is ready to be placed in a pocket. FIG. 6 provides a view of the combined element 600 disposed in the breast pocket 601 of a suit jacket. The combined element 600 may be disposed in other types of pockets.

The pocket 601 comprises a pocket pleat 603 coupled to a pocket pouch 605. The pocket pleat 603 at least partially defines the opening 607 of the pocket 601. The pocket 601 has a height Y and width X.

The combined element 600 is inserted into the pocket 601 via the opening 607. When inserted, the combined element 600, and more particularly the folded pocket square sleeve insert 210, will protrude from the pocket 601 at a height H. As described above, the folded pocket square sleeve insert 210 will typically protrude from the pocket 601 at a height of between ½ and 3 cm.

As shown in FIG. 6, pocket square holder 300 may be dimensioned to have a height—as defined when the pocket square holder 300 is folded substantially in half to hold the folded pocket square sleeve insert 210—that is less than the height Y of the pocket 601. Pocket square holder 300 may also be dimensioned to have a width that is less than the width X of the pocket 601. In some embodiments the pocket square holder 300 has a height of 11.5 cm (and a total length when unfolded of 23 cm) and a width of 7.5 cm.

Figure 10:
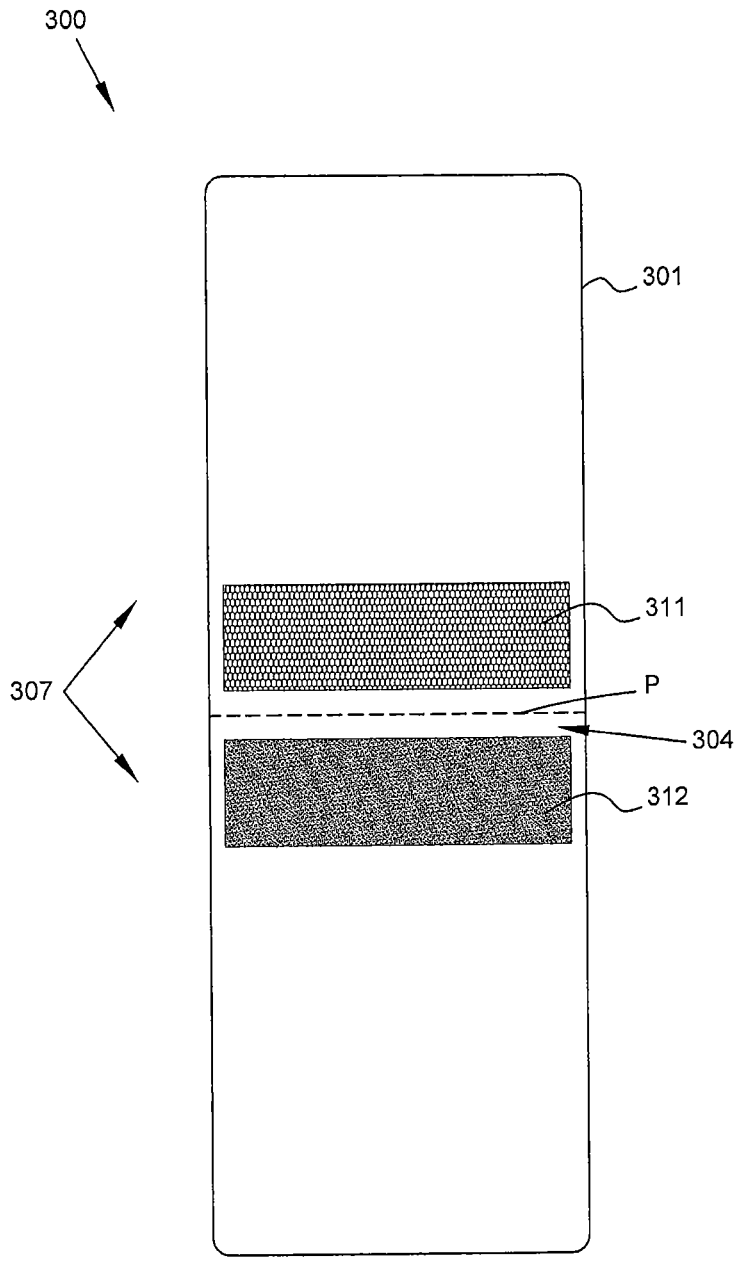
FIG. 10 is a simplified profile view of the interior side of a pocket square holder in accordance with some embodiments of the present disclosure.
Figure 11B:
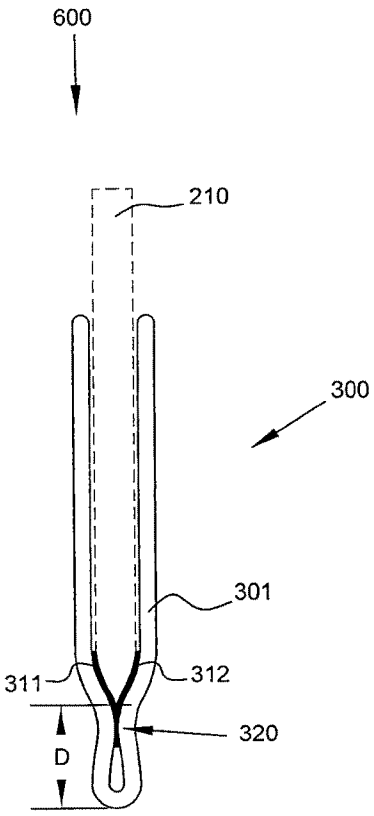
FIG. 11B is a simplified side profile view of a folded pocket square sleeve insert disposed in a pocket square holder in accordance with some embodiments of the present disclosure.
Figure 11A:
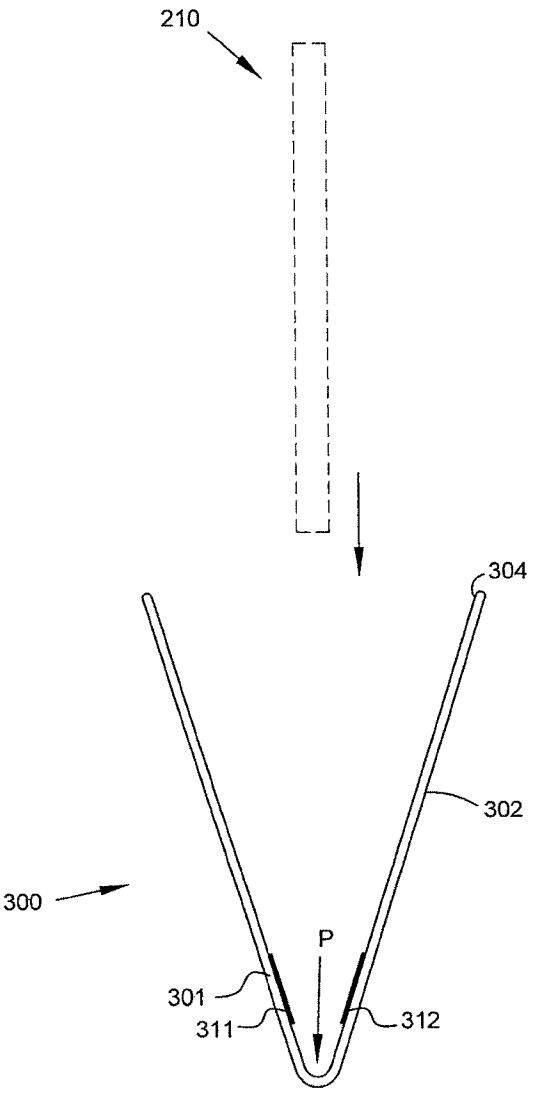
FIG. 11A is a simplified side profile view of the folded pocket square sleeve insert and pocket square holder in accordance with some embodiments of the present disclosure.

Although the illustrated embodiment of FIGS. 3A-3C comprises a loop panel 311 and a hook panel 312 that cover substantially all of the interior side 304, in some embodiments of the present disclosure the loop panel 311 and hook panel 312 are substantially smaller and limited to the region proximate the fold P. FIGS. 10 and 11A and 11B illustrate such an embodiment. In this embodiment with a limited loop panel 311 and hook panel 312, the fastening element 307 is still configured to hold opposing sides of the pocket square holder 300 together. Further, the pocket square holder 300 is able to perform the important function of allowing a user to set the depth D of a pocket square when disposed in a pocket by forming a holding bond proximate the bottom of the pocket square. The embodiment of FIG. 10 may also aid with preventing damage to the pocket square fabric that may be seen when utilizing the full fastening member 307 shown in FIGS. 3A-3C. Thus in both the embodiments of FIGS. 3A-3C and FIGS. 10 the pocket square holder 300 is configured to provide a selectably variable depth D for the pocket square when disposed in a pocket.

Figure 12B:
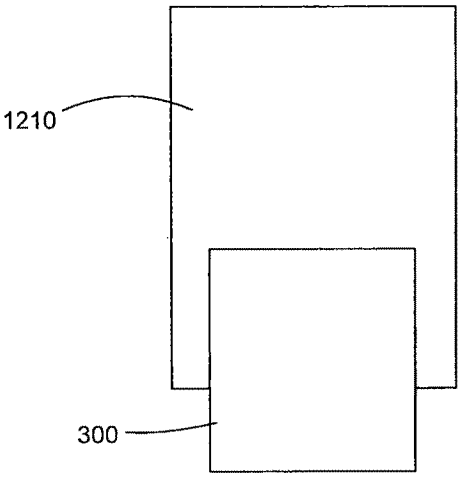
FIG. 12B is a profile view of a pocket square sleeve disposed in a pocket square holder in accordance with some embodiments of the present disclosure.
Figure 12A:
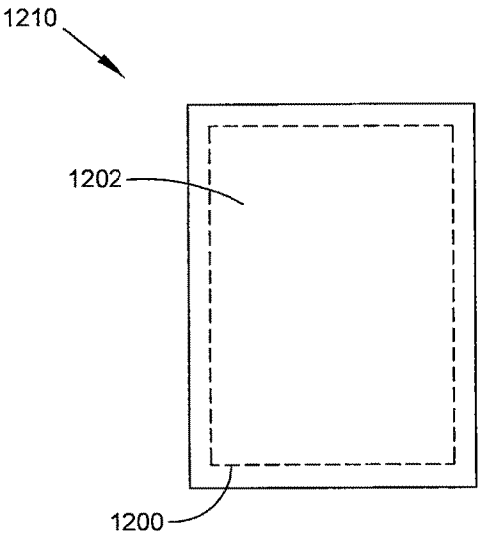
FIG. 12A is a profile view of a pocket square sleeve in accordance with some embodiments of the present disclosure.

In some embodiments, the sleeve 200 is substantially shorter in the length L dimension than that described above with reference to FIGS. 2A-2D. For example, in the embodiment shown in FIGS. 12A and 12B, the sleeve 1200 may be dimensioned to substantially fit into a pocket without folding. The sleeve 1200 may essentially comprise the portions defining cavity 1203, and cavity 1203 may be configured to receive insert 102. Cavity 1203 may be sewn shut to contain insert 102. In such an embodiment, the combined sleeve 1200 and insert 102, referred to as sleeve insert 1210, may be disposed in pocket square holder 300 substantially as described above and as indicated in FIG. 12B.

Figure 13:
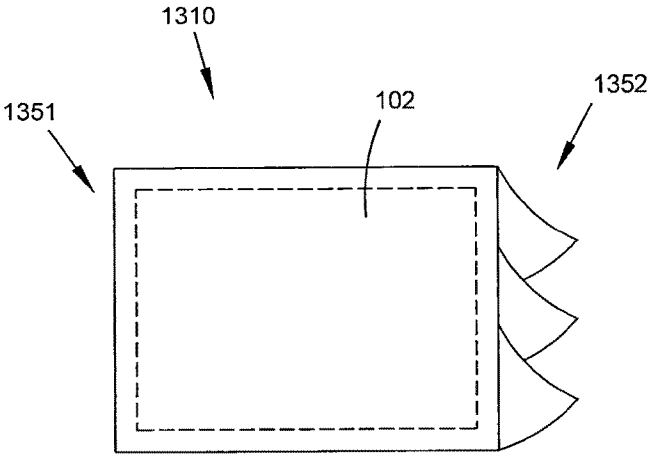
FIG. 13 is a profile view of a pocket square sleeve and insert combination in accordance with some embodiments of the present disclosure.

In some embodiments, a pocket square sleeve and insert combination 1310 may be double-sided, such that either of two sides may be displayed as protruding from a pocket. An example is provided in FIG. 13. The pocket square sleeve and insert combination 1310 comprises a pocket square sleeve and insert 102 substantially as described above. The combination 1310 may have a first side 1351 having a first display and a second side 1352 having a second display. In the illustrated example, the first side 1351 presents a linear display such that when placed in the pocket with first side 1351 protruding from the pocket the viewer will see a classic line of a pocket square. The illustrated example also has a second side 1352 that presents a folded pattern display such that when placed in the pocket with second side 1352 protruding from the pocket the viewer will see a folded pattern of the pocket square. In such embodiments, either or both of first side 1351 and second side 1352 may include a sewn seam or stitching to hold the presentation in place, or may be folded/patterned by the user prior to disposal in a pocket.

Figure 8:
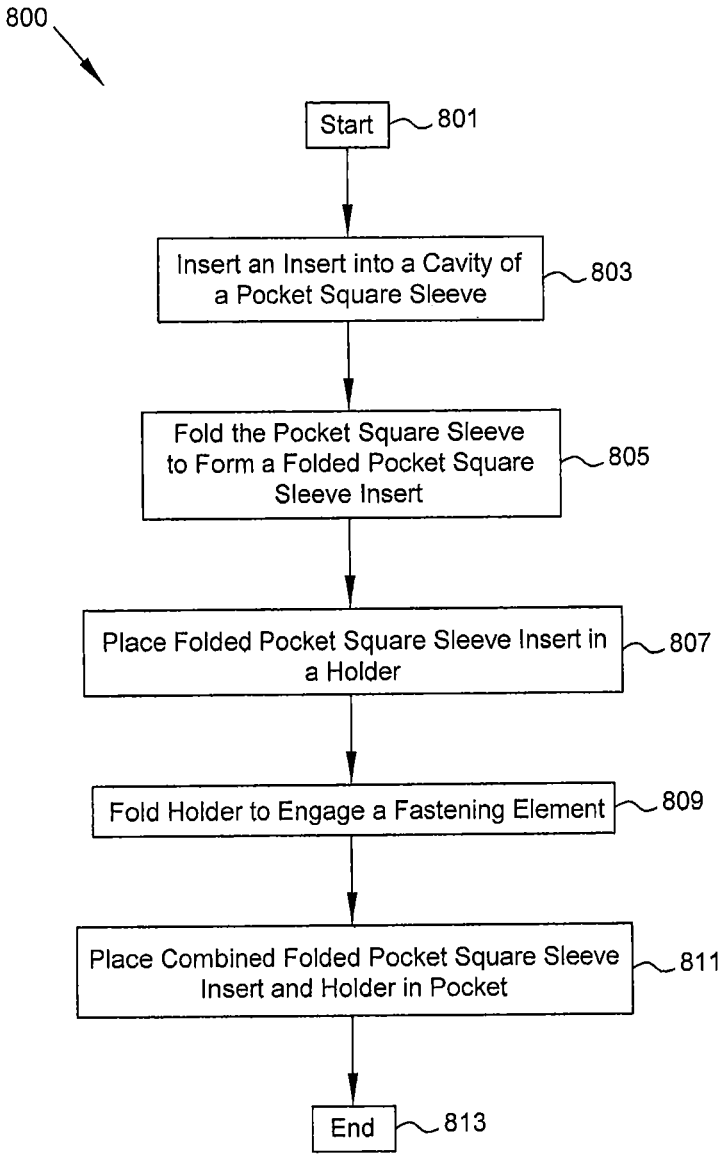
FIG. 8 is a simplified flow diagram of a method in accordance with some embodiments of the present disclosure.
Figure 9:
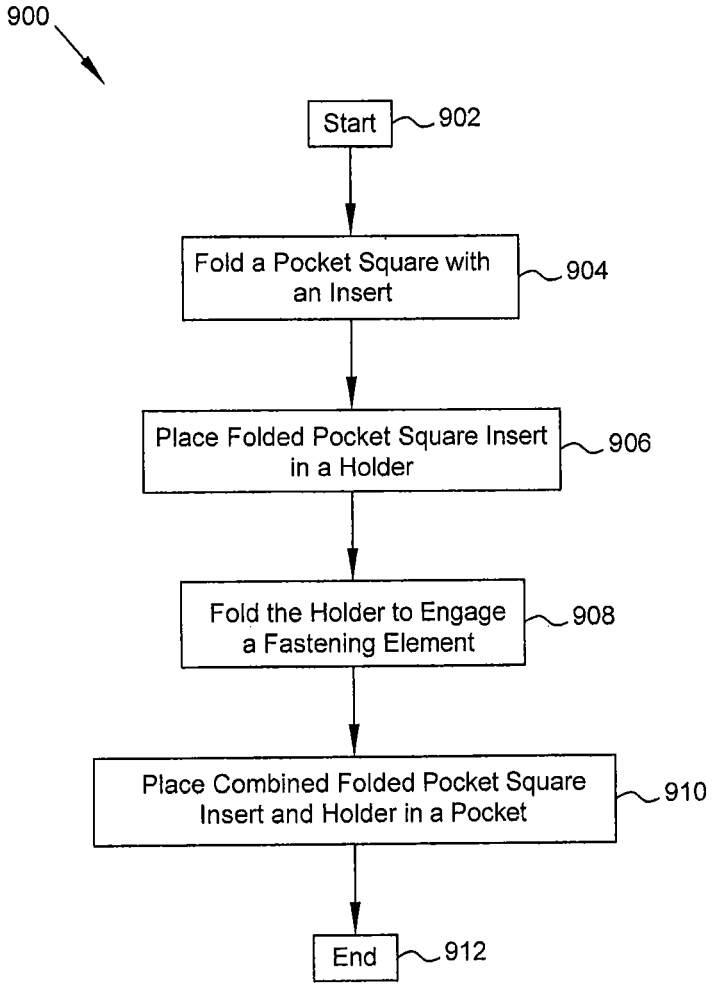
FIG. 9 is a simplified flow diagram of a method in accordance with some embodiments of the present disclosure.

In addition to the systems described above, the present disclosure provides methods of maintaining the form of a folded pocket square or folded pocket square sleeve, particularly when disposed in a pocket. FIG. 8 is a flow diagram of such a method 800. Method 800 begins at Block 801 and utilizes a pocket square sleeve 20Q and a pocket square holder 300 such as those described above with reference to FIGS. 2A-2D and 3A-3C. At Block 803 an insert 102 is inserted into the cavity 203 of the pocket square sleeve 200.

The pocket square sleeve 200 is then folded at Block 805 to form a folded pocket square sleeve insert 210. The pocket square sleeve 200 maybe folded in a single dimension, such as illustrated at FIGS. 2B and 2C, where the pocket square sleeve 200 and insert 102 are together folded in a single lateral dimension in quarters to effect a folded pocket square sleeve insert 210. The pocket square sleeve 200 maybe folded to achieve a folded pocket square sleeve insert 210 dimension to fit in a pocket, which may be the breast pocket of a suit jacket (such as the pocket 601 illustrated in FIG. 6).

At block 807 the folded pocket square sleeve insert 210 is placed in a pocket square holder 300, and at Block 809 the holder 300 is folded to engage a fastening element 307. The folded pocket square sleeve insert 210 maybe partially disposed in the holder 300, such that a portion of the folded pocket square sleeve insert 210 protrudes from the holder 300. The step of folding the holder 300 may comprise folding an elongate member 301 in a bi-fold manner such that a first portion of an interior surface 304 substantially faces a second portion of the interior surface 304.

Engagement of the fastening element 307 holds the holder 300 about the folded pocket square sleeve insert 210. At Block 811, the combined folded pocket square sleeve insert 210 and holder 300 maybe placed in a pocket, such as the pocket 601 illustrated in FIG. 6.

Method 800 ends at block 813.

A method 900 of maintaining the form of a pocket square is provided that utilizes a pocket square such as pocket square 100 illustrated in FIGS. 1A-1E and a pocket square holder such as pocket square holder 300 illustrated and FIGS. 3A-3C. Method 900 beings at Block 902 and proceeds to Block 904, where a pocket square 100 is folded to include an insert 102. At Block 906, the folded pocket square insert 110 is placed in a pocket square holder 300, and at Block 908 the pocket square holder 300 is folded to engage a fastening element 307. The combination of the folded pocket square insert 110 and pocket square holder 300 with engaged fastening element may be placed in a pocket at Block 910. Method 900 ends at Block 912.

In some embodiments of the present disclosure, systems and method of maintaining the form of a pocket square are presented substantially as described above, but without the use of a pocket square holder 300. Thus, a system of maintaining the form of a pocket square may comprise a pocket square sleeve 200 and insert 102. Once combined, the pocket square sleeve 200 and insert 102 may be disposed in a pocket without the use of a pocket square holder 300.

In some embodiments, the user may be presented with a kit having several inserts 102 of varying lengths. The user may select an insert 102 of an appropriate length to achieve a pocket square depth as desired. In such embodiments the insert 102 may both functionally provide rigidity to the pocket square and provide a grounding point against the bottom of the pocket to ensure the pocket square maintains a consistent distance of protrusion from the pocket. Thus, the functionality of both the insert 102 and pocket square holder 300 as described in earlier embodiments may be combined such that the insert 102 performs both functions. In some embodiments, the kit may provide three to five inserts 102, or more or less, with each of the inserts 102 having a length different from the other inserts 102 of the kit.

It should be noted that although the illustrated embodiments present a straight pocket square line (the pocket square protruding from the pocket is straight and usually substantially parallel with the pocket opening), additional shapes, folds, and patterns for the portion of the pocket square protruding from the pocket are contemplated with the disclosed systems and methods. The illustrated straight pocket square line may be referred to in the industry as a flat fold, Presidential fold, or TV fold.

The presently disclosed systems and methods therefore provide substantial advantages over the prior art. A system comprising a pocket square or pocket square sleeve, an insert, and a pocket square holder provides a degree of structure and rigidity to the folded pocket square to overcome the tendency of a pocket square to lose its form when worn in a pocket. The insert thus prevents bunching and sagging of the pocket square when disposed in the pocket. The structure and rigidity provided by the insert is achieved without the need for sewing or the use of difficult mechanisms such as the "change purse" sleeve. The structure and rigidity is also achieved with a combined element structure that is sufficiently thin so as not to be readily noticeable when placed in a pocket such as the breast pocket of a suit jacket.

The combination of a folded pocket square insert or folded pocket square sleeve insert with a pocket square holder allows for the adjustment of the height that the combined element will protrude from a pocket, and thus provides both flexibility to a user to alter the style of the pocket square and safeguards against the pocket square having an undesirable height of protrusion. The combination of a folded pocket square insert or folded pocket square sleeve insert with a pocket square holder also maintains the height of the pocket square protruding from the pocket during wear, and therefore prevents sagging of the pocket square.

The disclosed pocket square sleeve additional eliminates the need for lateral folding, and provides an easy-to-use location for placement of an insert. The reduced folding is particularly advantageous as the pocket square sleeve will more readily hold its form than a more-folded pocket square.

The use of an insert and pocket square holder is additionally advantageous because it will allow a user to utilize any pocket square they may have available, thus providing access to the full range of options that make pocket squares such a versatile accessory. A typical pocket square may be folded with an insert and placed in the pocket square holder to great effect. The disclosed systems and methods are therefore largely indifferent to the size, type of material, and shape of the selected pocket square.

As these advantages illustrate, the disclosed systems and methods improve the ability of a user to maintain the form of a pocket square when worn in a pocket while simultaneously maintaining the versatile nature of the pocket square. The disclosed systems and methods therefore correct a long felt need in the fashion industry for improvements to the use of pocket squares.

Although examples are illustrated and described herein, embodiments are nevertheless not limited to the details shown, since various modifications and structural changes may be made therein by those of ordinary skill within the scope and range of equivalents of the claims.

What is claimed is:

1. A system of maintaining the form of a pocket square comprising:

an insert comprising a semi-rigid material;

a pocket square sleeve comprising fabric sewn along a lengthwise seam to form a sleeve having a first and a second end, the lengthwise seam extending from the first end to the second end and forming a first closed side of the sleeve that is displaced from a second closed side of the sleeve, the lengthwise seam being substantially perpendicular to first end and second end, the second closed side extending from the first end to the second end, and a second seam substantially perpendicular to the lengthwise seam, wherein the lengthwise seam and the second seam partially define the boundaries of an first open-ended cavity configured to receive the insert in a releasably enveloping manner; and a holder comprising an elongate member and a fastening element, the elongate member configured to be folded to cause engagement of the fastening element;

wherein the insert is disposed in the cavity of the pocket square sleeve and the combined insert and pocket square sleeve is at least partially disposed in the holder.

2. The system of claim 1 wherein the pocket square sleeve is closed with a third seam proximate to the first end of the sleeve, the third seam being substantially perpendicular to the lengthwise seam.

3. The system of claim 2, wherein the second seam is proximate to the second end.

4. The system of claim 3, wherein the insert has a height measured in a direction substantially parallel to the lengthwise seam, and the second seam is displaced from the second end along the lengthwise seam by a distance approximately equal to the height of the insert.

5. The system of claim 4, wherein the lengthwise seam, second seam, third seam, and second closed side form an enclosed cavity.

6. The system of claim 1 wherein the pocket square sleeve is dimensioned such that folding the pocket square sleeve to fit into a pocket requires folding the pocket square sleeve around a direction substantially perpendicular to the lengthwise seam.

7. The system of claim 1 wherein the fastening element comprises a hook and loop fastener, with a hook panel disposed opposite a loop panel when the elongate member is in a folded position, wherein folding the holder about the combined insert and pocket square sleeve causes engagement of a portion of the hook panel with a portion of the loop panel.

8. The system of claim 1 wherein the fastening element comprises a pair of magnets, with a first magnet having a first polarity disposed opposite a second magnet having a second polarity when the elongate member is in a folded position, wherein folding the holder about the combined insert and pocket square sleeve causes engagement between the pair of magnets sufficient to hold the holder about the combined insert and pocket square sleeve.

9. A method of maintaining the form of a pocket square, the method comprising:

forming a pocket square sleeve by folding fabric along a lengthwise direction, sewing the folded fabric to form a lengthwise seam, thereby forming a sleeve having a first and a second end, the lengthwise seam extending from the first end to the second end and forming a first side of the sleeve that is displaced from a second side of the sleeve that extends between the first end and the second end, wherein the extending of the lengthwise seam consists of extending in a substantially lengthwise direction, and sewing the folded fabric to form a second seam that is substantially perpendicular to the lengthwise seam and displaced from the first end to form an open-ended cavity configured to receive an insert in a releasably enveloping manner;

inserting the insert into the cavity of the pocket square sleeve;

folding the pocket square sleeve having the insert disposed in the cavity to form a folded pocket square sleeve insert;

placing the folded pocket square sleeve insert in a holder, the holder comprising an elongate member and a fastening element; and folding the elongate member to engage the fastening element such that the folded pocket square sleeve insert is held by the holder.

10. The method of claim 9 wherein the step of folding the pocket square sleeve comprises folding around a direction substantially perpendicular to the lengthwise seam to achieve a folded pocket square sleeve insert dimensioned to fit in the breast pocket of a suit jacket.

11. The method of claim 9 wherein the step of folding the elongate member comprises folding the elongate member in a bi-fold manner such that a first portion of an interior surface of the elongate member faces a second portion of the interior surface.

12. The method of claim 11 wherein the fastening element comprises a hook and loop fastener, with a hook panel disposed opposite a loop panel when the elongate member is in a folded position, wherein folding the holder about the folded pocket square sleeve insert causes engagement of a portion of the hook panel with a portion of the loop panel.

13. The method of claim 11, wherein an exterior perimeter of the insert has a combined length that is unchanged during the step of folding the elongate member.

14. The method of claim 9 wherein the fastening element comprises a pair of magnets, with a first magnet having a first polarity disposed opposite a second magnet having a second polarity when the elongate member is in a folded position, wherein folding the holder about the folded pocket square sleeve insert causes engagement between the pair of magnets sufficient to hold the holder about the folded pocket square sleeve insert.

15. The method of claim 9, wherein forming the pocket square sleeve further comprises sewing the folded fabric to form a third seam that is substantially perpendicular to the lengthwise seam proximate to the second end of the sleeve.

16. The method of claim 15, wherein the second seam, third seam, first side, and second side form an enclosed cavity.

17. The method of claim 9, wherein the insert has a height measured in a direction substantially parallel to the lengthwise seam, and wherein inserting the insert into the cavity of the pocket square sleeve includes moving the insert past the first end by a distance approximately equal to the height of the insert.

18. A system comprising:

a semi-rigid insert dimensioned such that a majority of the insert fits within the breast pocket of a suit jacket;

a pocket square comprising a polygonal piece of folded fabric sewn along a lengthwise seam to form a sleeve having a first and a second end, the lengthwise seam extending from the first end to the second end and forming a first side of the sleeve that is displaced from a second side of the sleeve extending from the first end to the second end, the lengthwise seam being substantially perpendicular to the first and second ends, the fabric further sewn along a second seam substantially perpendicular to the lengthwise seam and displaced from the first end in a direction substantially parallel to the lengthwise seam at a distance approximately equal to a height of the insert measured along the lengthwise seam, wherein the lengthwise seam and the second seam partially define the boundaries of an open-ended cavity configured to releasably receive the insert, wherein the sleeve is closed with a third seam proximate to the second end of the sleeve and substantially perpendicular to the lengthwise seam; and a holder comprising an elongate member and a fastening element, the elongate member configured to be folded to cause engagement of the fastening element;

wherein the combined insert and pocket square is partially disposed within the holder, with the fastening element of the holder at least partially engaged.

19. The system of claim 18 wherein the fastening element comprises a hook and loop fastener, with a hook panel disposed opposite a loop panel when the elongate member is in a folded position, wherein folding the holder about the combined insert and pocket square causes engagement of a portion of the hook panel with a portion of the loop panel.

20. The system of claim 18, wherein the fastening element comprises a pair of magnets, with a first magnet having a first polarity disposed opposite a second magnet having a second polarity when the elongate member is in a folded position, wherein folding the holder about the combined insert and pocket square causes engagement between the pair of magnets sufficient to hold the holder about the combined insert and pocket square.

* * * * *